US008480280B2

(12) United States Patent
Kleppinger

(10) Patent No.: US 8,480,280 B2
(45) Date of Patent: Jul. 9, 2013

(54) LUMINESCENT DISPLAY DEVICE HAVING FILLER MATERIAL

(75) Inventor: James Kleppinger, Lancaster, PA (US)

(73) Assignee: Thomson Licensing, Boulogne-Billancourt (FR)

( * ) Notice: Subject to any disclaimer, the term of this patent is extended or adjusted under 35 U.S.C. 154(b) by 596 days.

(21) Appl. No.: 12/227,493

(22) PCT Filed: Jun. 28, 2006

(86) PCT No.: PCT/US2006/025221
§ 371 (c)(1), (2), (4) Date: Nov. 19, 2008

(87) PCT Pub. No.: WO2008/002311
PCT Pub. Date: Jan. 3, 2008

(65) Prior Publication Data
US 2009/0129060 A1 May 21, 2009

(51) Int. Cl.
*F21V 7/04* (2006.01)

(52) U.S. Cl.
USPC ..... 362/601; 362/600; 362/602; 362/603; 362/607

(58) Field of Classification Search
USPC ..... 362/600–634
See application file for complete search history.

(56) References Cited

U.S. PATENT DOCUMENTS

| | | | | |
|---|---|---|---|---|
| 4,205,255 | A | 5/1980 | Tomita | |
| 5,082,355 | A * | 1/1992 | Warszawski | 359/265 |
| 5,783,904 | A * | 7/1998 | Liu et al. | 313/495 |
| 7,002,289 | B1 | 2/2006 | Porter et al. | |
| 7,291,963 | B2 | 11/2007 | Haraguchi | |
| 2005/0093421 | A1 | 5/2005 | Kodera et al. | |
| 2006/0125372 | A1 | 6/2006 | Tanaka et al. | |
| 2006/0284545 | A1 | 12/2006 | Haraguchi | |
| 2007/0014318 | A1 * | 1/2007 | Hajjar et al. | 372/9 |

FOREIGN PATENT DOCUMENTS

| | | | |
|---|---|---|---|
| EP | 1727184 | A1 | 11/2006 |
| JP | 54-012259 | | 1/1979 |
| JP | 2234332 | A | 9/1990 |
| JP | 10-301300 | A | 11/1998 |
| JP | 10-308181 | A | 11/1998 |
| JP | 11-162361 | A | 6/1999 |
| JP | 2000021340 | | 1/2000 |
| JP | 2000251797 | | 9/2000 |
| JP | 2001-143617 | A | 5/2001 |
| JP | 2001351510 | | 12/2001 |
| JP | 2002-014336 | A | 1/2002 |
| JP | 2002-091344 | A | 3/2002 |
| JP | 2002-175764 | | 6/2002 |
| JP | 2003346647 | | 12/2003 |

(Continued)

OTHER PUBLICATIONS

International Search Report, dated Feb. 14, 2007.

*Primary Examiner* — William Carter
(74) *Attorney, Agent, or Firm* — Robert D. Shedd; Richard LaPeruta

(57) ABSTRACT

A luminescent display has a plurality of individual discreet phosphor elements (33) on a glass plate separated from one another, filler material (45) between the phosphor elements and reflective film over the individual phosphor elements (33). The filler material (45) can be white and contact the sides of the phosphor elements (33). The filler material (45) can have a peak height that is at least half of the height of the individual phosphor elements (33) between which the filler material (45) lies.

10 Claims, 9 Drawing Sheets

FOREIGN PATENT DOCUMENTS

| | | | |
|---|---|---|---|
| JP | 2005122949 | A | 5/2005 |
| JP | 2005-268109 | A | 9/2005 |
| JP | 2005-268124 | A | 9/2005 |
| JP | 2006-66201 | A | 3/2006 |
| JP | 2006-164854 | A | 6/2006 |
| WO | 2005/091324 | A1 | 9/2005 |

* cited by examiner

LUMINESCENT DISPLAY DEVICE HAVING FILLER MATERIAL

This application claims the benefit, under 35 U.S.C. §365 of International Application PCT/US2006/025221 filed Jun. 28, 2006, which was published in accordance with PCT Article 21(2) on Jan. 3, 2008, in English.

FIELD OF THE INVENTION

The invention pertains to a screen structure for a luminescent display device.

BACKGROUND OF THE INVENTION

In a luminescent display such as a Field Emission Display (FED), as shown in FIG. 1, electrons 18 from a plurality of emitters 16 in a cathode 7 strike phosphor elements 33 on an anode plate 4 and cause photon emission 46. As shown in FIG. 1, a current practice in FED technology is to apply a transparent conductor 1 (e.g., indium tin oxide) to the glass substrate 2 of the anode plate 4. Phosphor elements 33 are applied over the transparent conductor 1. Potential 15 is applied to the anode 4 during display operation. To emit electrons 18 from particular array emitter apertures 25, a gate potential $V_q$ is applied to specific gates 26 which may be supported on some dielectric material 28. The dielectric material 28 and electron emitters 16 can be supported on a cathode assembly 31 which can be supported on a cathode back plate 29, which in turn is supported on back plate support structure 30.

The brightness of the image that results can be greatly enhanced by applying a thin, reflective metal film 21 on the cathode side of the phosphor. Essentially, the reflective metal film 21 can double the light 46 observed by the viewer. The reason is the reflective metal film 21 reflects the portion of emitted light that propagates away from the viewer toward the viewer. (When the phosphor is excited, light is emitted in all directions. Also, the intensity of the light initially emitted from the phosphor toward and away from the viewer is about equal).

In FEDs, the reflective metal film 21 must be smooth and continuous in regions over the phosphor to efficiently direct light 46 toward the viewer. If the film is rough or discontinuous (i.e., having voids) or both, some emitted light initially propagating away from the viewer may not be reflected toward the viewer. FIG. 2 shows a profile of an individual phosphor element 33 in a finished assembly. The individual phosphor particles 39 are also shown. The aluminum layer 21 is shown having voids 38 which tend to reduce the light output, because light will escape through the voids. Some of the voids are created when the anode plate is baked-out to remove organic materials and some voids can be created due to the topography of the deposited phosphor elements 33. FIG. 3 shows an example of the phosphor element after the reflective metal film 21 is applied (which is typically by chemical vapor deposition of aluminum) and prior to bake out. Pockets 41 within the phosphor elements can comprise binder and/or organic materials used in the deposition process. (The organic material can include those used to print the phosphor elements using a photoresist process or other known printing processes.) Organic materials need to be baked out to have an operational FED. FIG. 3 also shows a lacquer film layer 42 which is applied before the reflective metal film 21. (The lacquer film layer 42 is typical applied by spin coating). The film layer 42 is used to provide a smooth continuous substrate onto which the aluminum is applied.

Without the lacquer film layer 42 to provide a smooth substrate, the reflective metal film 21 is typical very poor in quality and may not assist in increasing light output to an extent otherwise possible.

To provide FEDs which efficiently propagate light toward the viewer, reflective metal films 21 of high quality are necessary and screen structure characteristics promoting the propagation of emitted light toward the viewer are needed.

SUMMARY OF THE INVENTION

A luminescent display has a plurality of individual discreet phosphor elements on a glass plate separated by gaps. The gaps contain filler material that can be white. The filler material contacts the sides of the phosphor elements. The filler material can have a peak height that is at least half of the height of the individual phosphor elements between which the filler material lies. Preferably, the filler material can have a height the same as that of adjacent phosphor deposits. A reflective metal film is present over the individual phosphor elements.

DETAILED DESCRIPTION OF THE INVENTION

Figure 4:
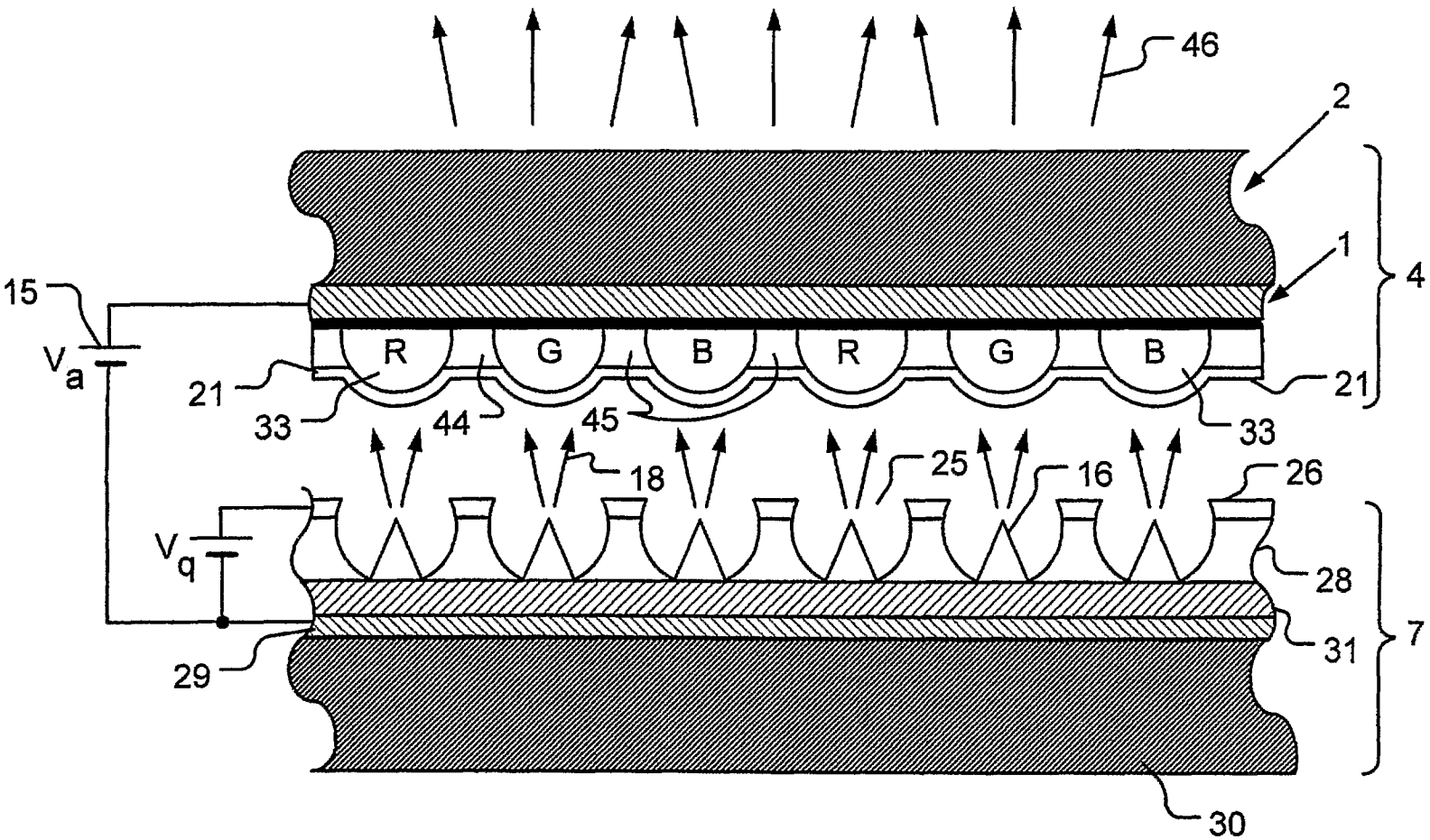
FIG. 4 is a sectional view of a field emission display according to the invention.

An exemplary embodiment of the present invention will next be described with reference to the accompanying figures. As shown in FIG. 4, a cathode 7 comprises a plurality of emitters 16 arranged in an array that emit electrons 18 due to an electric field created in the cathode 7. These electrons 18 are projected toward the anode 4.

Figure 5:
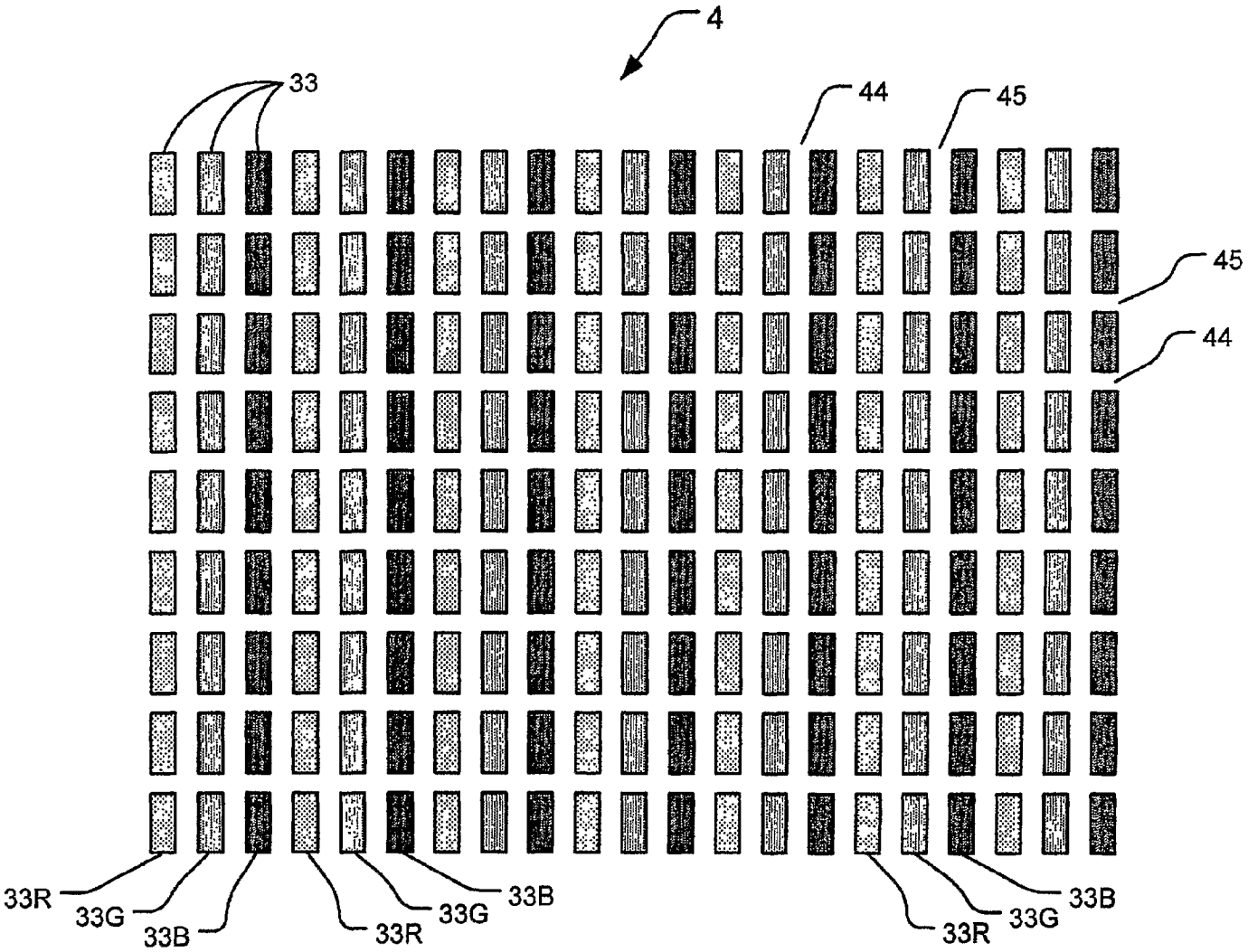
FIG. 5 is a plan view of a plurality of phosphor elements having filler in gaps in the field emission display according to the invention.

The anode 4 can comprise a glass substrate 2, having a transparent conductor 1 deposited thereon. The individual phosphor elements 33 can then be applied to the transparent conductor 1 and can be separated from one another. The phosphor elements 33 can comprise red phosphor (R), green phosphor (G), and blue phosphor (B), as shown in FIG. 4. The phosphor elements 33 can be formed by known screen printing techniques such as photoresist processing. Gaps 44 are defined between the individual phosphor elements 33. Filler material 45 is deposited in the gaps 44. The filler material effectively is a deposit of material built up over a plane defined by the surface to which the phosphor elements are deposited. The filler material can also be formed after the phosphor elements are deposited by known printing techniques or settling from a slurry formulation. The filler material 45 can be an inert material and particulate in nature (although not shown in the figures), wherein the particle size can be as large as that of the phosphor particles. "Inert" implies that the material can survive baking at elevated temperatures typically used for FED manufacturing. In a preferred embodiment, the inert material is white in the sense that the material is a polycrystalline material (which can be anisotropic) or an inherently white material. Titanium dioxide or zirconium dioxide are suitable materials. FIG. 5 shows a plan view of an array of phosphor elements 33, wherein the red phosphor elements 33R, green phosphor elements 33G, and blue phosphor elements 33B are ordered in repeat columns with the filler material 45 contained in gaps 44. The gaps can run in rows and columns. As shown in FIG. 4, a continuous layer of a reflective film 21 can be deposited on both the phosphor elements 33 and the filler material 45. The reflective film 21 can be reflective metal film. In another embodiment, the phosphor elements of a particular color can be stripes with no gaps 44 present along the stripes.

Figure 1:
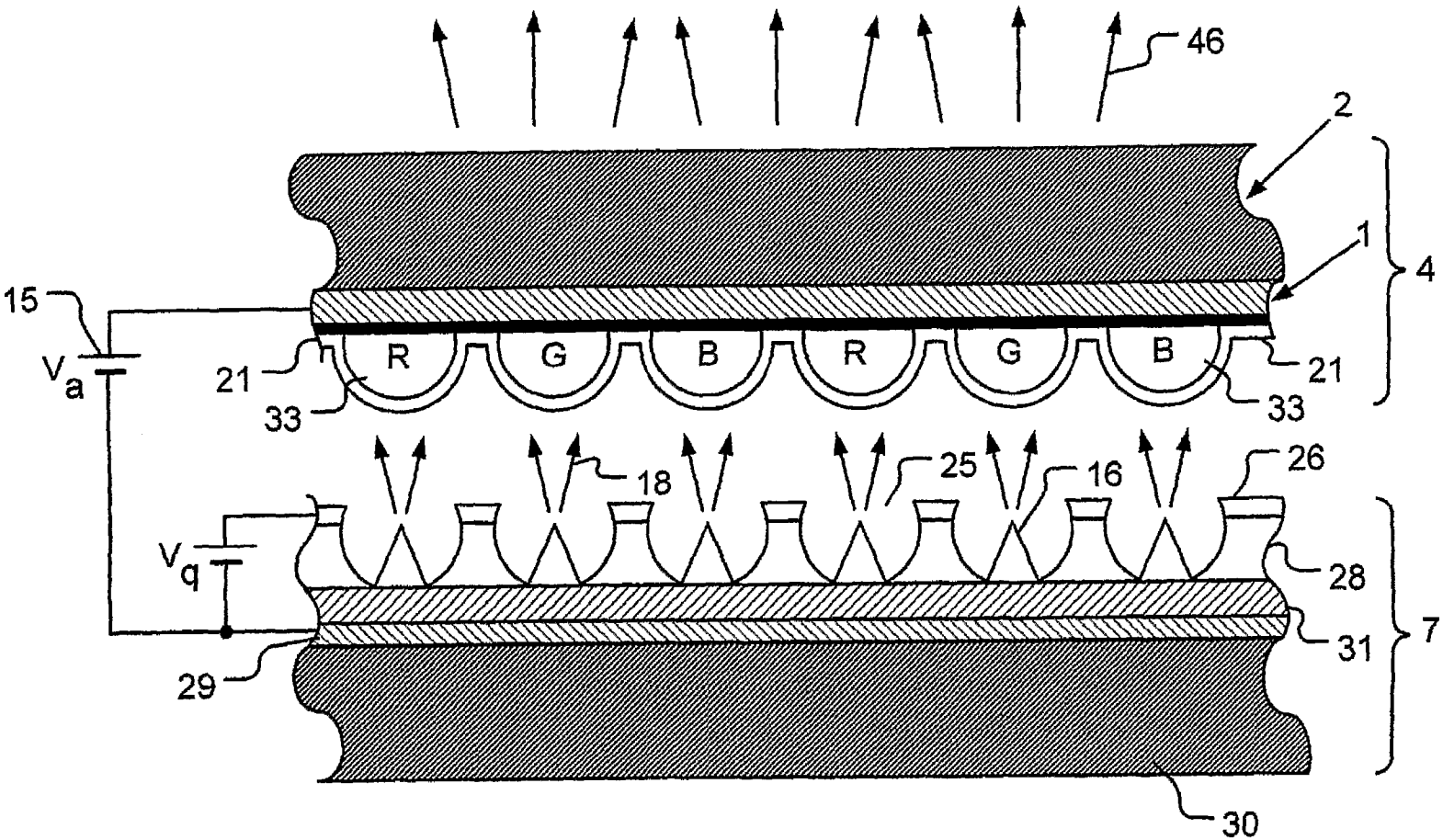
FIG. 1 (PRIOR ART)
FIG. 1 is a sectional view of an existing field emission display.
Figure 2:
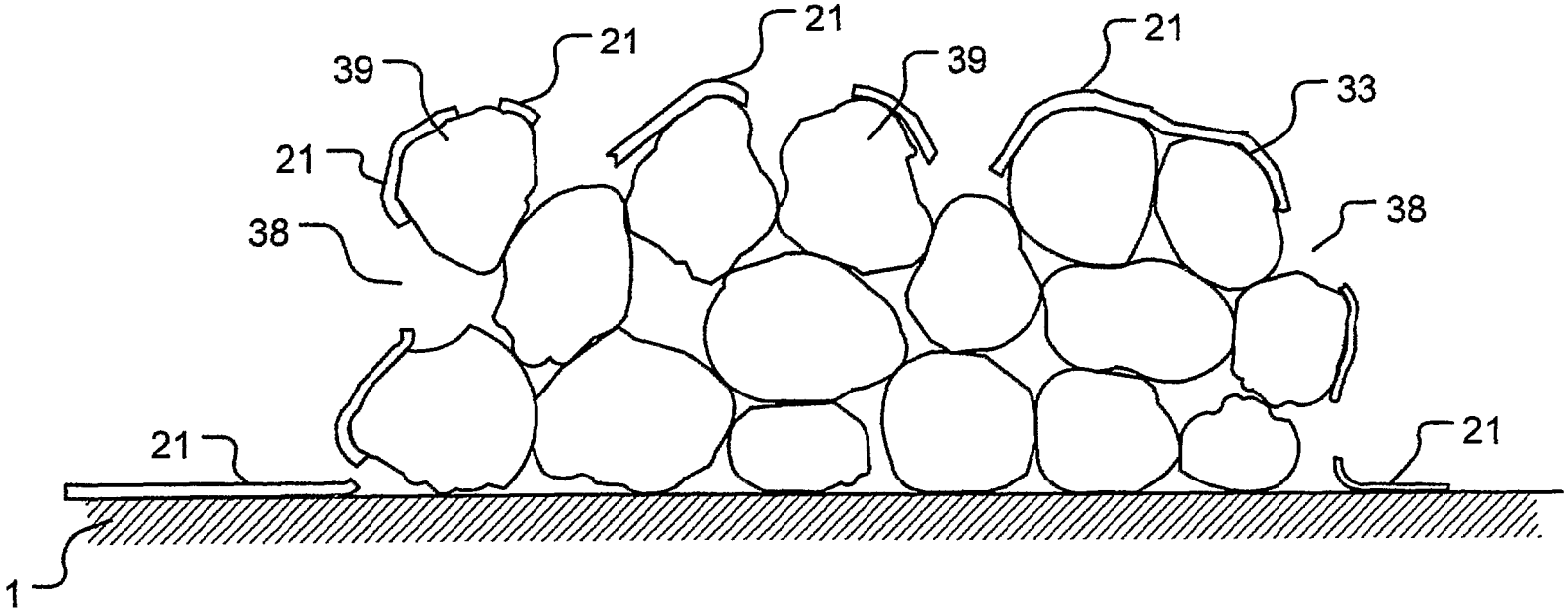
Fig. 2 (Prior Art)
FIG. 2 is a sectional view of a phosphor element of the existing field emission display.
Figure 3:
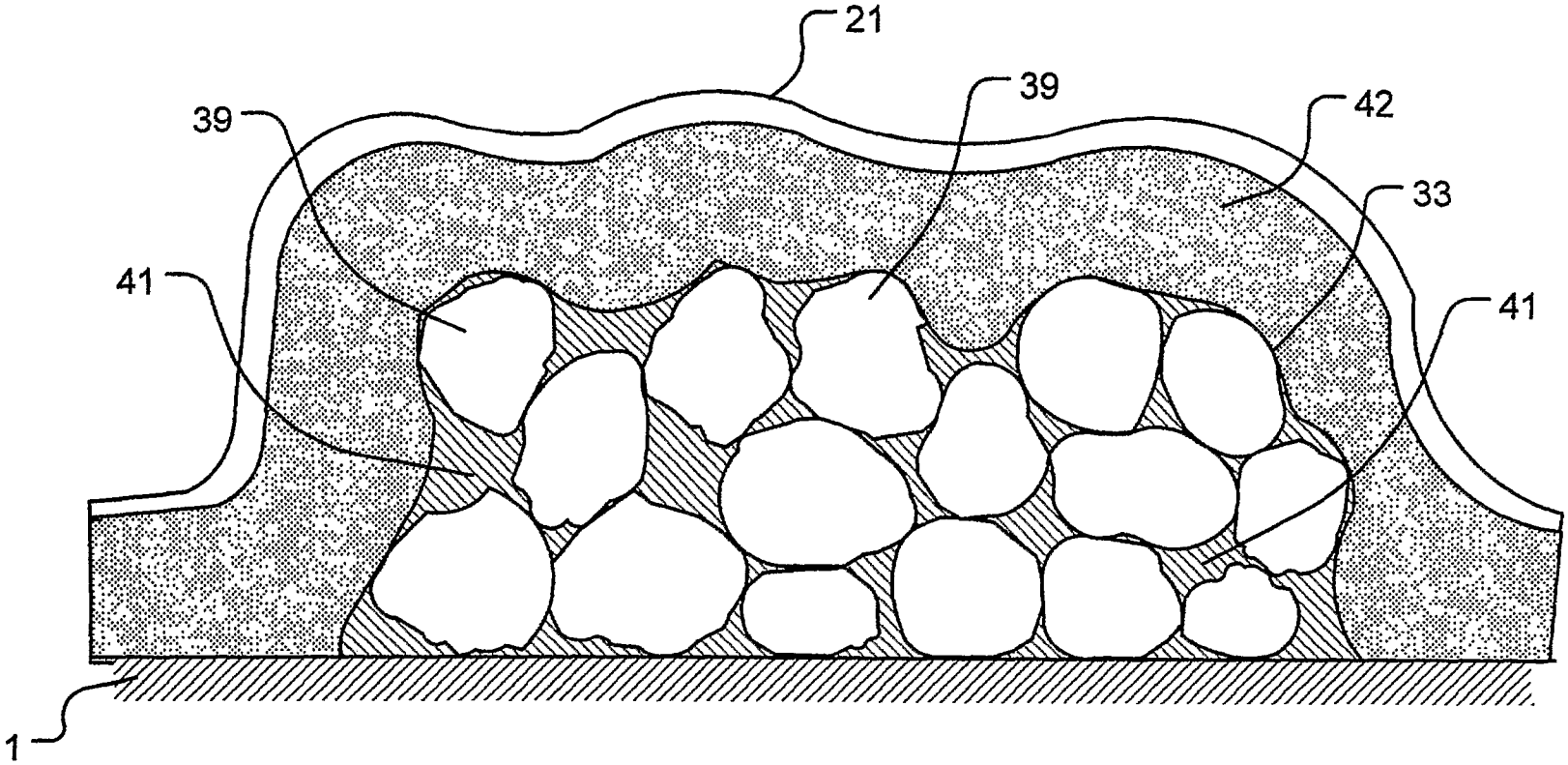
FIG. 3 (Prior Art)
FIG. 3 is a sectional view of a phosphor element of the existing field emission display prior to bake out.
Figure 6:
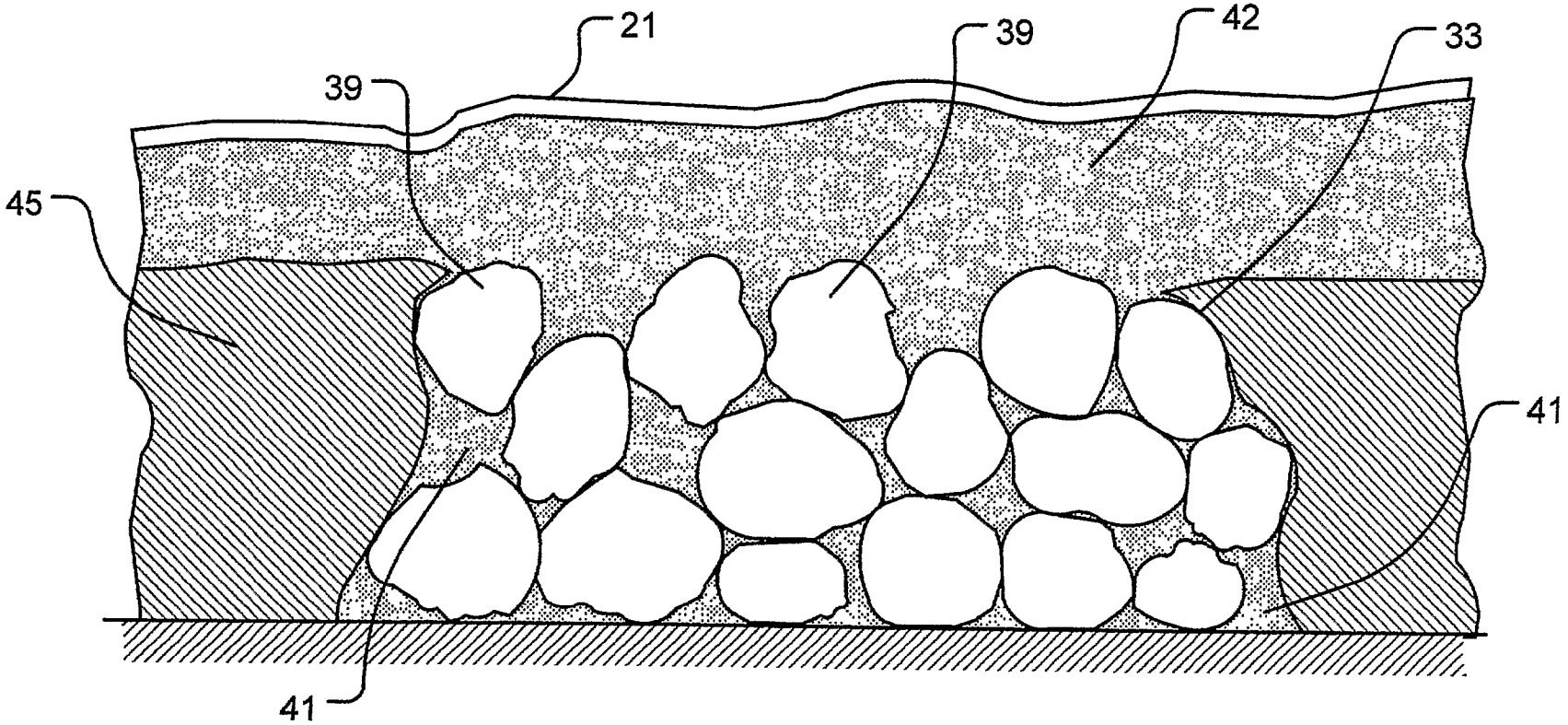
FIG. 6 is a sectional view of a phosphor element according to the invention.
Figure 7:
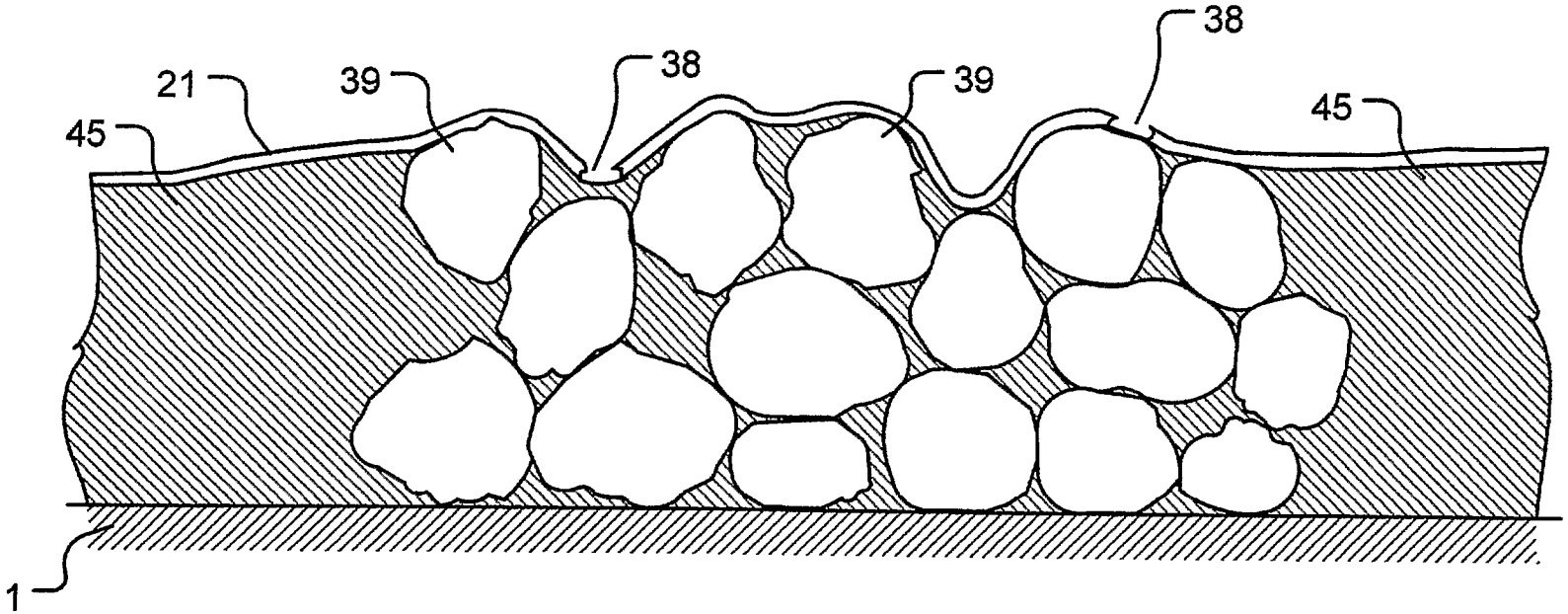
FIG. 7 is a sectional view of a phosphor element according to the invention after bake out.
Figure 8:
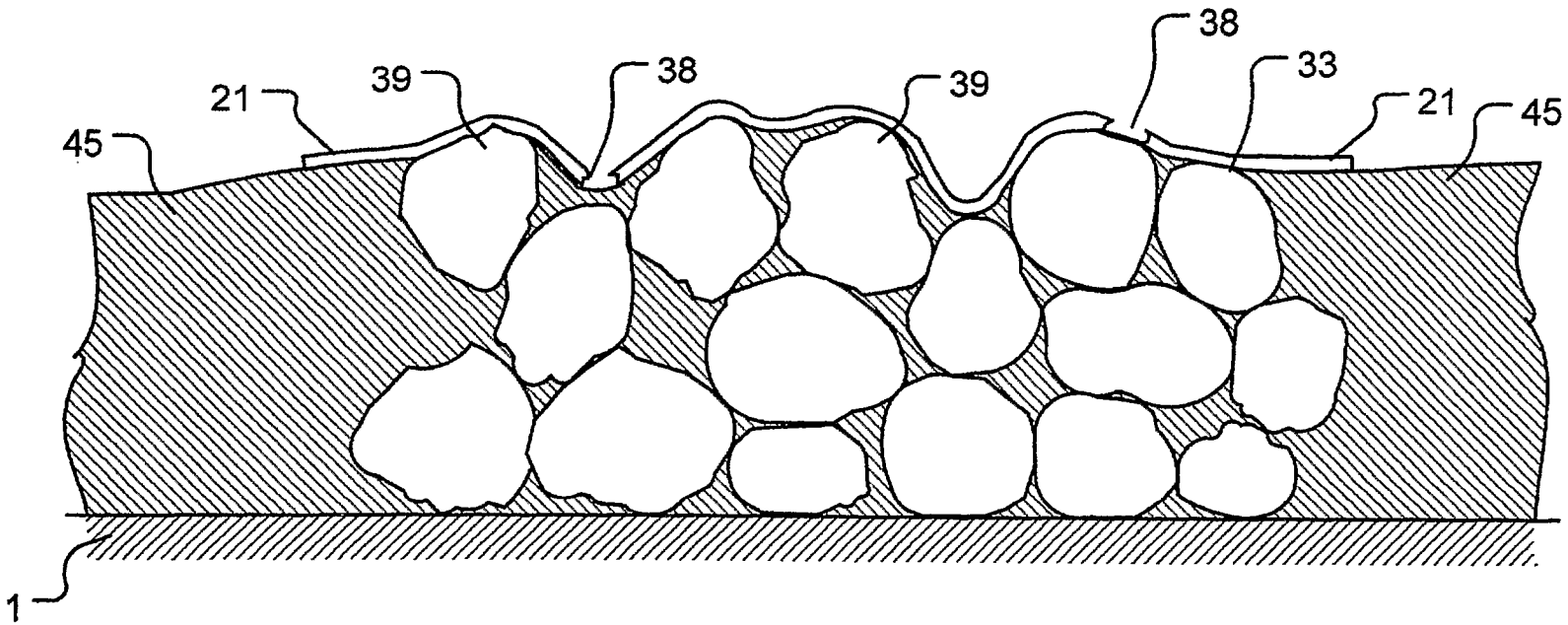
FIG. 8 is a sectional view of a phosphor element according to another embodiment of the invention after bake out.

FIG. 6 shows a cross section of a given phosphor element 33 according to the invention. Specifically what is shown is an example of the phosphor element after the reflective metal layer 21 is applied. The reflective metal layer can be aluminum. Pockets 41 within the phosphor elements can comprise binder and/or organic materials used in the deposition process. Organic materials need to be baked out to have an operational FED. FIG. 7 shows the phosphor element 33 after bake out. In this case, because the filler material 45 is in intimate contact with the sides of the phosphor element 33, no reflective metal film on these sides of the phosphor elements 33. Thus, the absence of the reflective metal film on the sides of the phosphor element 33 means that there is no concern for voids 38 in the reflective metal film 21 on the sides, as there is in the prior art as shown in FIG. 2. Rather the filler material 45, if it is reflective in nature (such as a white material), will behave to reflect and/or scatter emitted light 46 that propagates toward the sides of the phosphor elements 33 away from the sides, thereby increasing the incidence of the emitted light 46 to exit toward the viewer. The filler material makes a surface with less contour depressions for the lacquer film to fill-in and for the reflective metal film 21 to collapse into after bake out, compared to a screen without filler. In other words, the filler material makes a more uniform height surface. Further, the filler promotes a more uniform localized surface topography making the lacquer film smoother. As such, the incidence of filming streaks of lacquer will be reduced providing a more favorable surface for the aluminum layer. In addition, it has been learned that because the reflective metal layer 21 is closer to being planar in the current invention, compared to that of the prior art with no filler, there is less stress placed on the reflective metal film 21 during bake out. The reflective metal film 21 must settled onto to the surface that it is to cover. In the current invention the settling of the reflective metal layer is gentle and uniform, which is particularly the case near the side of the phosphor elements. In the prior art, the settling of the reflective metal layer is not as uniform, wherein the reflective metal layer 21 in the gaps 44 may have to move or settle a greater distance than portions of the metal layer on the phosphor elements. Hence, use of the current invention yields less voids 38 in the reflective metal layer 21.

With an improved quality smooth film and less voids formed in the reflective metal film 21, the intensity of light reflected by the reflective metal film 21 is increased. Further, the filler material being white reflects and scatters any emitted light 46 incident on it back into the phosphor elements, thereby increasing the intensity of light exiting toward the viewer.

Filler material 45 having a height of at least half of that of the phosphor elements are preferred. However, having the phosphor elements and the filler material being substantially the same in height is ideal. Substantially the same can mean the heights being within 20% of each other.

Other embodiments of the invention are contemplated. For example, the invention is intended to include embodiments where portions of the reflective metal film 21 are isolated from one another. This helps to reduce the level of arcing current that can occur during an electrical short between the anode and cathode. With such isolation, only charge isolated in areas where a short occurs will arc, as opposed to all of the charge in the FED detrimentally arcing when there is no isolation. Embodiments where the reflective metal film is segmented provides the added benefit of permitting volatilized gases generating during a bake out process to easily escape through locations not covered by the reflective metal. When these gases escape in such areas, these gases will not be forced to escape through the reflective metal film. As such, the reflective metal film can better maintain its structural integrity and avoid being perforated by gases passing through the reflecting metal film during bake out.

Other embodiments include the use of black matrix material on the anode in the gaps 44. In such embodiments, the filler material 45 will be applied on the matrix material. The use of matrix material has the advantage of increasing the contrast of the display. The invention can apply to luminescent displays containing phosphor elements excited by electrons ejected from some emitter such as in FEDs or SEDs (Surface-Conduction Electron-Emitter Displays).

Figure 9:
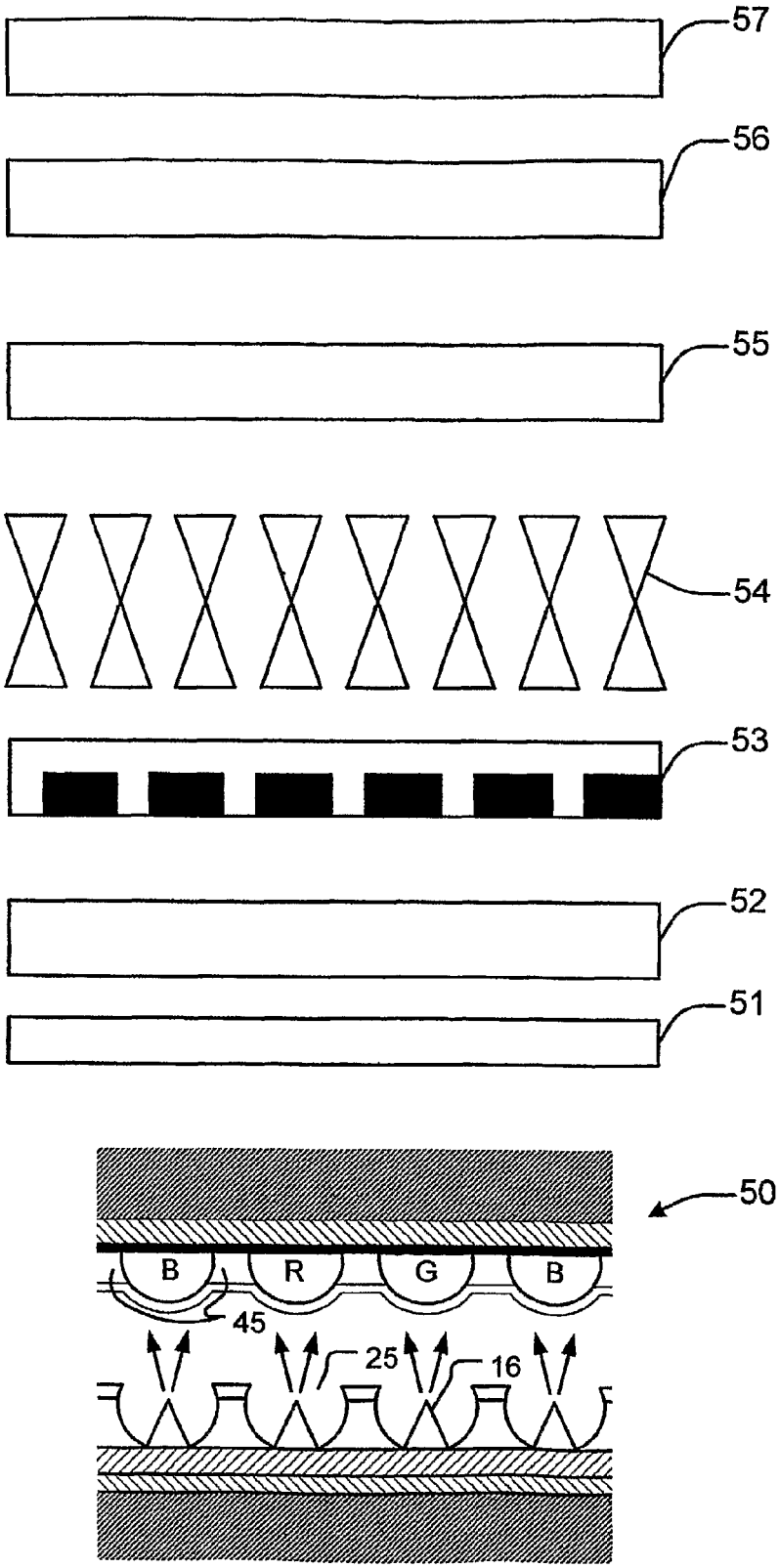
FIG. 9 is a sectional view of an LCD display using an FED back light according to another embodiment of the invention.

Further, the invention is intended to include embodiments wherein the luminescent display is a liquid crystal device (LCD) utilizing an efficient FED containing the phosphor elements and filler materials which were previously described. In these embodiments, the efficient FEDs essentially provide the back lighting for the LCD. FIG. 9 shows a basic design, where the FED 50 is positioned before a diffuser 51. Following the diffuser 51 is a polarizer 52 and a thin film transistor 53. The device further includes the liquid crystal materials 54 positioned after the thin film transistor 53. The LCD device can also include a glass plate 55, a second polarizer 56 and a surface treatment film 57, as shown and ordered in FIG. 9. Although this configuration of the liquid crystal device is shown, the invention can include the FED components being a back light for LCDs having different configurations and different components, with the minimum configuration requirement being the FED 50 as a back light generating light to impinge pixel cells containing liquid crystal material. A key advantage to using an FED as a back light is that it can operate in a color sequential mode, thereby reducing or eliminating the need for color filters.

The invention claimed is:

1. A field emission display, comprising:

a plurality of phosphor elements separated from one another by gaps, the phosphor elements having a top portion and side portions;

white filler material in the gaps, the white filler material being between the phosphor elements and the white filler material contacting the side portions of the phosphor elements;

black matrix material in the gaps, wherein the white filler material is on the black matrix material between the phosphor elements; and a segmented reflective film contacting and covering the top portion of the phosphor elements and at least some of the white filler material, wherein portions of the segmented reflective film are separated from one another in the gaps.

2. The field emission display of claim 1, wherein the white filler material has a height being at least one half that of the phosphor elements.

3. The field emission display of claim 1, wherein the white material has a height being substantially the same as that of the phosphor elements.

4. The field emission display of claim 1, wherein the white filler material is titanium dioxide or zirconium dioxide.

5. The field emission display of claim 1, wherein the white filler is polycrystalline.

6. A luminescent display, comprising:

a plurality of phosphor elements separated from one another by gaps, the phosphor elements having a top portion and side portions;

white filler material in the gaps and between the phosphor elements, the white filler material contacting the side portions of the phosphor elements;

black matrix material in the gaps, wherein the white filler material is on the black matrix material between the phosphor elements; and a reflective metal film contacting and covering the top portion of the phosphor elements and at least some of the white filler material and being segmented, wherein portions of the reflective film are separated from one another in the gaps.

7. The luminescent display of claim 6, wherein the filler material has a height being at least one half that of the phosphor elements and reflects or scatters light incident thereon into adjacent phosphor elements to increase light output of the luminescent display.

8. The luminescent display of claim 6, wherein the white filler material includes titanium dioxide or zirconium dioxide.

9. The luminescent display of claim 6, wherein the white filler material is polycrystalline.

10. A liquid crystal display comprising:

a liquid crystal front end device; and a field emission device back light, the field emission device comprising:

a plurality of phosphor elements separated from one another by gaps, the phosphor elements having a top portion and side portions, white filler material contacting the side portions of the phosphor elements and being between the phosphor elements, black matrix material in the naps, wherein the white filler material is on the black matrix material between the phosphor elements, and a reflective metal film positioned over the phosphor elements, the reflective metal film being segmented from one another in the gaps and the reflective metal film contacting and covering the top portion of the phosphor elements and at least some of the white filler material.

* * * * *